US011427424B2

(12) United States Patent
Wang et al.

(10) Patent No.: US 11,427,424 B2
(45) Date of Patent: Aug. 30, 2022

(54) ROLLED GOOD FEEDING DEVICE AND METHOD

(71) Applicant: NIKE, Inc., Beaverton, OR (US)

(72) Inventors: Guo Chang Wang, Taichung (CN); Qi Feng Zheng, Guangdong (CN); Bin Fu, Guangdong (CN)

(73) Assignee: NIKE, INC., Beaverton, OR (US)

( * ) Notice: Subject to any disclaimer, the term of this patent is extended or adjusted under 35 U.S.C. 154(b) by 122 days.

(21) Appl. No.: 16/958,527

(22) PCT Filed: Dec. 19, 2018

(86) PCT No.: PCT/US2018/066505
§ 371 (c)(1),
(2) Date: Jun. 26, 2020

(87) PCT Pub. No.: WO2019/133385
PCT Pub. Date: Jul. 4, 2019

(65) Prior Publication Data

US 2021/0053786 A1 Feb. 25, 2021

(30) Foreign Application Priority Data

Dec. 27, 2017 (CN) ..... 201711441317.9

(51) Int. Cl.
*B65H 16/08* (2006.01)
*B65H 16/02* (2006.01)
(Continued)

(52) U.S. Cl.
CPC ..... *B65H 16/08* (2013.01); *B65H 16/021* (2013.01); *B65H 23/032* (2013.01);
(Continued)

(58) Field of Classification Search
CPC .... B65H 16/08; B65H 16/021; B65H 23/032; B65H 23/044; B65H 23/0326; B65H 23/185; B65H 23/1825; B65H 2513/106
See application file for complete search history.

(56) References Cited

U.S. PATENT DOCUMENTS 4,384,686 A * 5/1983 Wiley ..... B65H 23/0326 226/20
4,461,431 A 7/1984 Wiley et al.
(Continued)

FOREIGN PATENT DOCUMENTS

CN 2747036 Y 12/2005
CN 1910099 A 2/2007
(Continued)

OTHER PUBLICATIONS

International Preliminary Report on Patentability received for PCT Patent Application No. PCT/US2018/066505, dated Jul. 9, 2020, 9 pages.
(Continued)

*Primary Examiner* — Sang K Kim
(74) *Attorney, Agent, or Firm* — Shook, Hardy & Bacon L.L.P.

(57) ABSTRACT

The present application relates to rolled good feeding device and method. Material feeding devices and methods are provided for conveying material from material rolls. The material roll may be adjusted in the longitudinal direction during the feeding process by a rectifying frame to aid in maintaining alignment during the unrolling. Tension of the unrolled material may be monitored and unrolling speeds of the feeding device can be adjusted to maintain tension of the material within a range for that material. Aspects also
(Continued)

contemplate elements to feed multiple rolled materials simultaneously for subsequent processing in combination as layered materials.

18 Claims, 5 Drawing Sheets

(51) Int. Cl.
*B65H 23/032* (2006.01)
*B65H 23/04* (2006.01)
*B65H 23/182* (2006.01)
*B65H 23/185* (2006.01)

(52) U.S. Cl.
CPC ..... *B65H 23/0326* (2013.01); *B65H 23/044* (2013.01); *B65H 23/185* (2013.01); *B65H 23/1825* (2013.01); *B65H 2513/106* (2013.01); *B65H 2515/31* (2013.01)

(56) References Cited

U.S. PATENT DOCUMENTS

| | | | | |
|---|---|---|---|---|
| 10,399,809 | B2 * | 9/2019 | Montoya | B65H 23/182 |
| 2005/0167460 | A1 | 8/2005 | Franz et al. | |
| 2015/0121985 | A1 * | 5/2015 | Nunota | B65H 16/08 72/324 |
| 2017/0152120 | A1 | 6/2017 | Montoya et al. | |

FOREIGN PATENT DOCUMENTS

| | | | |
|---|---|---|---|
| CN | 104310088 | A | 1/2015 |
| CN | 204297761 | U | 4/2015 |
| CN | 204607205 | U | 9/2015 |
| CN | 106167188 | A | 11/2016 |
| CN | 104310087 | B | 1/2017 |
| CN | 207861539 | U | 9/2018 |
| JP | 59-185521 | A | 10/1984 |
| JP | 60-137754 | A | 7/1985 |
| JP | 63-12571 | A | 1/1988 |
| JP | 63-252865 | A | 10/1988 |
| JP | 6-31328 | A | 2/1994 |
| KR | 10-2013-0081447 | A | 7/2013 |
| WO | 2012159808 | A1 | 11/2012 |

OTHER PUBLICATIONS

International Search Report in related application PCT/US2018/066505, dated Mar. 27, 2019, 3 Pages.

* cited by examiner

ROLLED GOOD FEEDING DEVICE AND METHOD

CROSS-REFERENCE TO RELATED APPLICATIONS

This application is a national stage application, filed under 35 U.S.C. § 371, of International Patent Application No. PCT/US2018/066505, filed on Dec. 19, 2018, entitled "ROLLED GOOD FEEDING DEVICE AND METHOD," which claims priority to Chinese App. No. 201711441317.9, filed on Dec. 27, 2017, the entirety of the aforementioned applications are incorporated by reference herein.

BACKGROUND OF THE INVENTION

Traditionally rolled goods, such as a roll of fabric, is placed with a mandrel (e.g., a rod) extending through the rolled good to support the rolled good as material is pulled (e.g., unwound) from the rolled good. Therefore, the roll of material is unrolled through a pulling (e.g., tension force) action on the material to cause the material roll to rotate about the mandrel. To accomplish the unrolling, a sufficient tension is applied to the material to cause a rotation of the whole roll of the material.

SUMMARY OF THE INVENTION

Material feeding devices and methods are provided for conveying material from material rolls. The material roll may be adjusted in the longitudinal direction during the feeding process by a rectifying frame to aid in maintaining alignment of the material during the unrolling. Tension of the unrolled material may be monitored and unrolling speeds (e.g., ultimately adjusting a conveying speed) of the feeding device can be adjusted to maintain tension of the material within a range for that material. Aspects also contemplate elements to feed multiple rolled materials simultaneously for subsequent processing in combination as layered materials.

This summary is provided to enlighten and not limit the scope of methods and systems provided hereafter in complete detail.

BRIEF DESCRIPTION OF THE DRAWING

The present invention is described in detail herein with reference to the attached drawing figures, wherein.

DETAILED DESCRIPTION OF THE INVENTION

Figure 1:
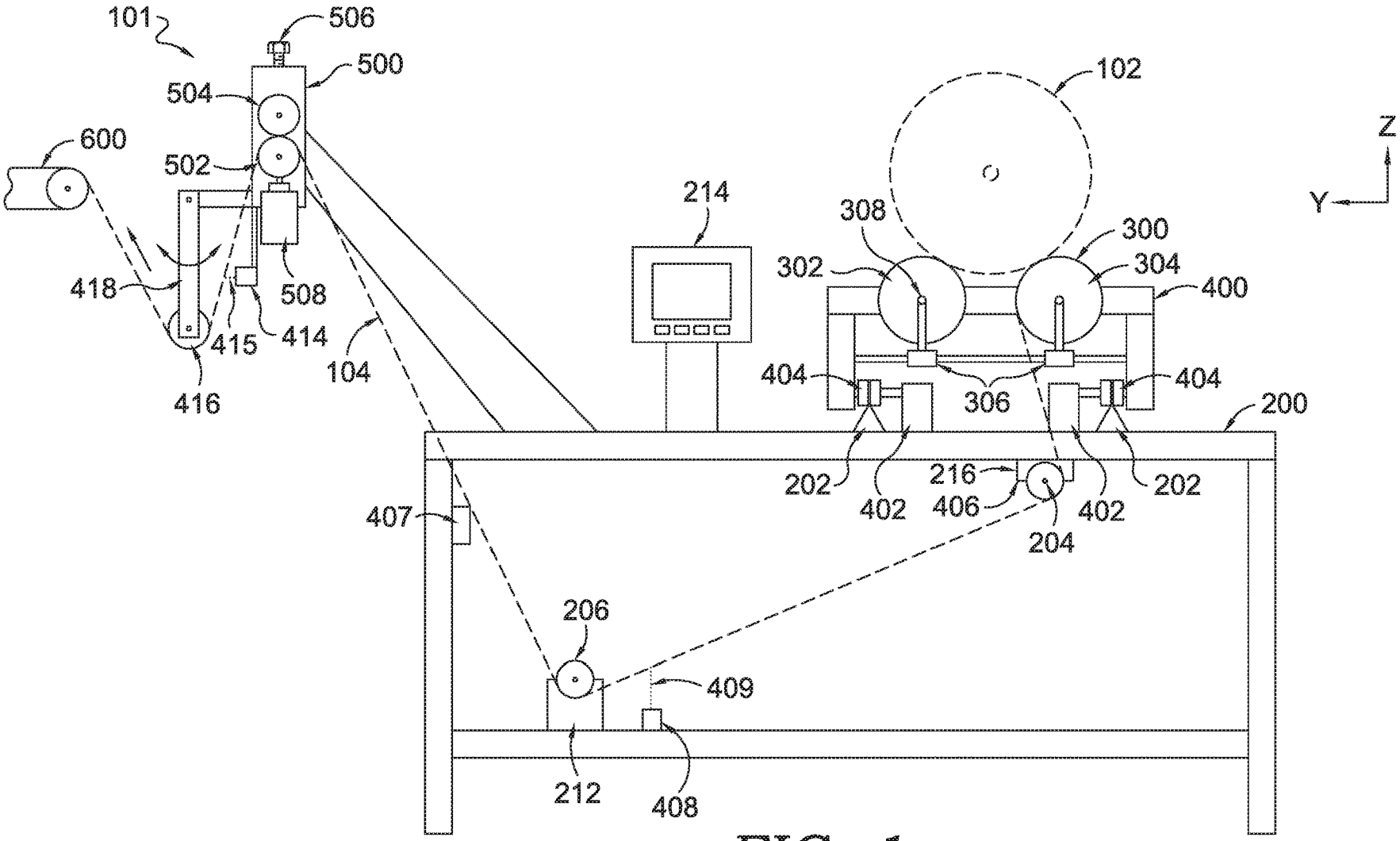
FIG. 1 depicts side plan view of a simplified material feeder, in accordance with aspects hereof.

Traditional rolled good feeding apparatuses convert a tension force passed through the material being unrolled to rotational energy that rotates the rolled good about a mandrel passing through a center of the rolled good. This tension passing through the material to cause the unrolling may be significant. For example, a roll of material used in an industrial/commercial environment may weight 100's of kilograms that therefore requires a sufficient force to pass through the material to overcome resistive forces (e.g., static friction, dynamic friction) to allow the roll of material to begin rotating. This extreme tensile force transferred through the material may deform or otherwise damage the material. For example, some materials may not have sufficient resilience to return to a pre-tensioned state once fed through a roll feeding device that relies on pulling the material to rotate the material roll. Other materials may have sufficient resilience to return to partially, but not uniformly, to a pre-tensioned state. This deformation or alteration of the material may be detrimental to subsequent manufacturing. For example, inconsistencies and other variations to a pulled material from a roll may be inserted into the manufacturing process by the deformations and/or damage caused by the tension applied to unroll the material. As such, aspects hereof contemplate a roller combination supporting the rolled material. The roller combination rotates the roll instead of relying on tensile force transferred through the material itself to cause the unrolling.

Further, to maintain consistency of materials fed from a roll feeding device, maintaining tension within a prescribed range may be achieved. For example, to achieve appropriate feed rates and to prevent material damage, maintaining a prescribed range of tension can aid in maximizing material feeding. As a roll of material is unrolled, a diameter of the roll is generally reduced. Aspects hereof contemplate a roller combination that supports the material roll from below and the roller combination is powered to rotate causing the rolled material to rotate and unroll. As the diameter of the material roll reduces, an increased unrolling rate of the rolled material can occur if the roller combination rotates at a constant speed. Therefore, as more material is unrolled, the amount of material fed from the feeding machine increases. Monitoring tension of the material as unrolled can ensure the rate of feeding is adjusted appropriately to compensate for variations in the material roll size and the like.

Further yet, when unrolling a material to be processed in a subsequent manufacturing step (e.g., laser cutting, die cutting, printing, painting, spraying, trimming, bonding), alignment of the material with the subsequent operation enhances efficiencies. For example, if a material as it is unrolled from the material roll and the material deviates (e.g., offsets or moved) positionally in an axial direction (e.g., a direction parallel to the longitudinal length of the material roll) during the unrolling, the material enters the subsequent operation in an inefficient manner. This inefficient manner can cause miss-operations, such as cutting beyond an edge, miss-alignment with elements included on the unrolled material, and the like. Therefore, aspects hereof contemplate a rectifying frame that adjusts a position of the material roll as material is unrolled. The adjusted position of the material roll compensates or rectifies the position of the unrolled material for subsequent processing. The rectifying frame allows the unrolled material to stay within an operating region of the roll feeding device by repositioning the material roll in a direction parallel with the rotational axis of the rolled good being unrolled.

Additionally, in some examples, multiple material rolls may be unrolled concurrently. The different unrolled materials from the concurrently unrolled material rolls may be layered and processed simultaneously in a subsequent operation. When multiple layers are simultaneously processed in a subsequent operation, which can increase machine utilization at the subsequent operation, manufacturing defects may occur. Manufacturing defects may result if material layers lack alignment and/or if material layers experience different tensions during a feeding/unrolling operation (e.g., deformation, damage). Therefore, aspects hereof contemplate applying independently controlled rectifying frames with each of the material rolls to aid in rectifying a position in the axial direction between the two or more material rolls, the roll feeding machine, and/or a subsequent processing machine. As such, multiple rolled materials may be concurrently unrolled and fed to a subsequent operation while maintaining relative position within a tolerance through actions of the rectifying frame and supporting devices to adjust axial positions of each material roll independently. The tension of each unrolled material portion from different material rolls concurrently being unrolled may also be adjusted to maintain appropriate tensions of the materials to prevent deformation, damage, or offsets due to inconsistent tensioning, for example.

Aspects hereof contemplate a feeding device (e.g., a material feeder). The feeding device includes a roller combination comprised of a first roller and a second roller. The first roller and the second roller having parallel rotational axis. The feeding device further comprises a drive assembly adapted to rotate the roller combination in a rotational first direction and in a rotational second direction effective to roll and convey a rolled material. Further, the feeding device includes a rectifying frame joined with the roller combination and adapted to axially position the roller combination to rectify a position of the material conveyed from the automatic feeding device.

Additional aspects contemplate a material feeding method using a roller combination having two rollers with parallel axis of rotation. The method includes driving the roller combination to rotate allowing a rolled material carried thereon to roll and be conveyed. The method also includes driving a rectifying frame to move the roller combination in a direction parallel to the axis of rotation thereby rectifying the position of the material when an offset of the position of the material is detected after the roller combination is driven to rotate.

The following figures include a number of elements summarized below.

100—material feeder
101—single roll material feeder
102—rolled material
102(*a*)—first rolled material
102(*b*)—second rolled material
104—unrolled material
104(*a*)—first unrolled material
104(*b*)—second unrolled material
200—frame
202—rectifying rail
204—initial roller
206—tension roller
208—first supplemental roller
210—second supplemental roller
212—tension sensor
214—computing device
216—material sensor
300—roller combination
302—first roller
304—second roller
306—drive assembly
308—rotational axis
400—rectifying frame
402—movement system
404—caster
406—position sensor
407—position sensor
407(*a*)—position sensor
407(*b*)—position sensor
408—position sensor
408(*b*)—position sensor
409—position detection
410—position sensor
410(*b*)—position sensor
411—position detection
412—position sensor
412(*b*)—position sensor
413—position detection
414—tension sensor
415—tension detection
416—tension roller
418—tension roller link
500—dispensing assembly
502—drive roller
504—compression roller
506—compression adjuster
508—drive unit
600—receiving unit The following figures are exemplary in nature and are not limiting. Instead, the figures are depicted in a schematic style and not limiting as to size, shape, position, or number. Further, the simplified nature of schematic figures omits element details to provide greater clarity. However, while element details may be omitted from the figures, it is understood that such details are included and intended in exemplary aspects.

Turning to FIG. 1, which depicts a single material feeder 101, in accordance with aspects hereof. The material feeder 101 is comprised of the frame 200, the roller combination 300, the rectifying frame 400, the dispensing assembly 500, and the exemplary receiving unit 600 (e.g., a laser cutting machine, a dies-cut machine, a print machine, a welding machine, an oven, a cooling station, a printer, and other manufacturing operation machine).

The frame 200 forms a foundation supporting and providing relational stability to one or more additional elements of the material feeder 101. The frame may be formed from any material, such as metal. The frame is comprised of one or more rectifying rails 202. The rectifying rail 202 is a portion of the frame on which the rectifying frame 400 traverses in an x-axis in FIGS. 1-5. The x-axis is an axis that is parallel to the rotational axis 308 of the roller combination 300. The rotational axis 308, stated differently, is an axis of rotations extending through one or more rollers of the roller combination 300. The rotational axis 308 is also parallel to a longitudinal direction of the first roller 302 and the second roller 304, in an exemplary aspect. The rectifying rail 202 is parallel with the axis of rotation of the roller combination 300 to allow for positional adjustment of unrolled material from the rolled material 102. The rectifying rail 202 may be statically mounted to the frame 200 to provide a secure track upon which the rectifying frame 400 moves.

Additional aspects of the frame 200 will be highlighted following a discussion of the roller combination 300 and the rectifying frame 400.

The rectifying frame 400 provides an operable support structure for the roller combination 300 to reposition the roller combination 300 along the x-axis of FIGS. 1-5 for rectifying a position of material unrolled from the rolled material 102 supported by the roller combination 300. The rectifying frame 400 includes one or more movement systems 402, one or more casters 404, and one or more position sensors 406.

The movement system 402 is a motion generating device, such as an electric motor, linear actuator, hydraulic motor, hydraulic cylinder, pneumatic cylinder, and the like. Additionally, the movement system 402 may include one or more links, gears, pulleys, belts, chains, and the like to operatively connect the motion-generating portion of the movement system 402 with one or more translating components, such as the caster 404. For example, it is contemplated that an electric motor is operatively coupled with a caster 404 through one or more gears to cause the caster 404 to move in response to energy generated by the electric motor. As a result, the caster 404 is effective to move the rectifying frame 400 across the frame 200 to rectify a position of the rolled material 102.

Alternatively, the caster 404 may be free-wheeling and rotating independently of a coupling to a movement system 402. For example, the movement system 402 may implement one or more screw drives or cable systems coupling the rectifying frame 400 with the frame 200 without directly transferring motion energy through the caster 404. Stated differently, it is contemplated that the caster 404 may either be an active drive component to rectify the position of the roller combination or it may be a passive component that reacts to indirect forces applied to the rectifying frame 400 to rectify a position of the roller combination 300.

As will be appreciated throughout, different combinations of components (e.g., sensors, rollers, systems, and the like) may be implemented in various configurations. For example, the position sensor 406 may be used exclusively to detect an edge position of the unrolled material 104. In an alternative aspect, the position sensor 408 may be used exclusively to detect an edge position (or any position) of the unrolled material 104. Similarly, it is contemplated that a combination of sensors may be implemented to detect a position of a material. For example, the position sensor 406 may be used in combination with the position sensor 408 in other aspects. Similarly, multiple tension sensors (e.g., tension sensor 212 and tension sensor 414) are disclosed. It is contemplated that the tension sensors may be used individually or in combination. In a first aspect, the tension sensor 212 may be used exclusively to determine a tension of the unrolled material 104. In another aspect, it is contemplated that the tension sensor 414 may be used exclusively to detect a tension (or a representation of tension) of the unrolled material 104. Further, it is contemplated that a combination of tension sensors may be used collectively to monitor and/or detect tension of the material at different location along a material flow or to monitor and/or detect tension holistically.

The position sensor 406 detects a position of one or more portions of the material (e.g., the rolled material 102 and/or the unrolled material 104) being fed by the roller combination 300. The position sensor 406 may be on a first side only of the material or multiple position sensors may be used in different locations. An example of a multiple sensor configuration includes a first position sensor that detects a first edge of the material and a second position sensor that detects an opposite edge of the material. The absence and/or presence of the material in the field of sensing for each of the position sensors may be used as an indicator of material position for signaling the rectifying frame 400. For example, as the unrolled material 104 deviates in the x-axis direction due to unrolling, the position sensor 406 detects the edge moving outside of a tolerable zone, which causes the rectifying frame 400 to move in a direction to bring the material edge back into the tolerable zone. The position sensor 406 may be a contact sensor or a non-contact sensor. Examples of a non-contact sensor include an ultrasonic sensor, a visible-light sensor, an infrared sensor, and the like. It is contemplated that any combination of sensors and any number of sensors may be implemented. Further, it is contemplated that the position sensor 406 may be positioned relative to the rolled material 102 and/or the unrolled material 104 at any location, such as an edge in the x-axis direction.

The position sensor 406 is depicted in a common location as the material sensor 216. It is contemplated that the position sensor 406 and the material sensor 216 may be commonly positioned, common sensors, separate sensors, and/or separately positioned. Stated differently, it is contemplated that two or more sensors/devices provided herein may be coupled logically and/or physically in an exemplary aspect. It is also contemplated that two or more sensors/devices provided herein may be decoupled logically and/or physically in an exemplary aspect.

Figure 3:
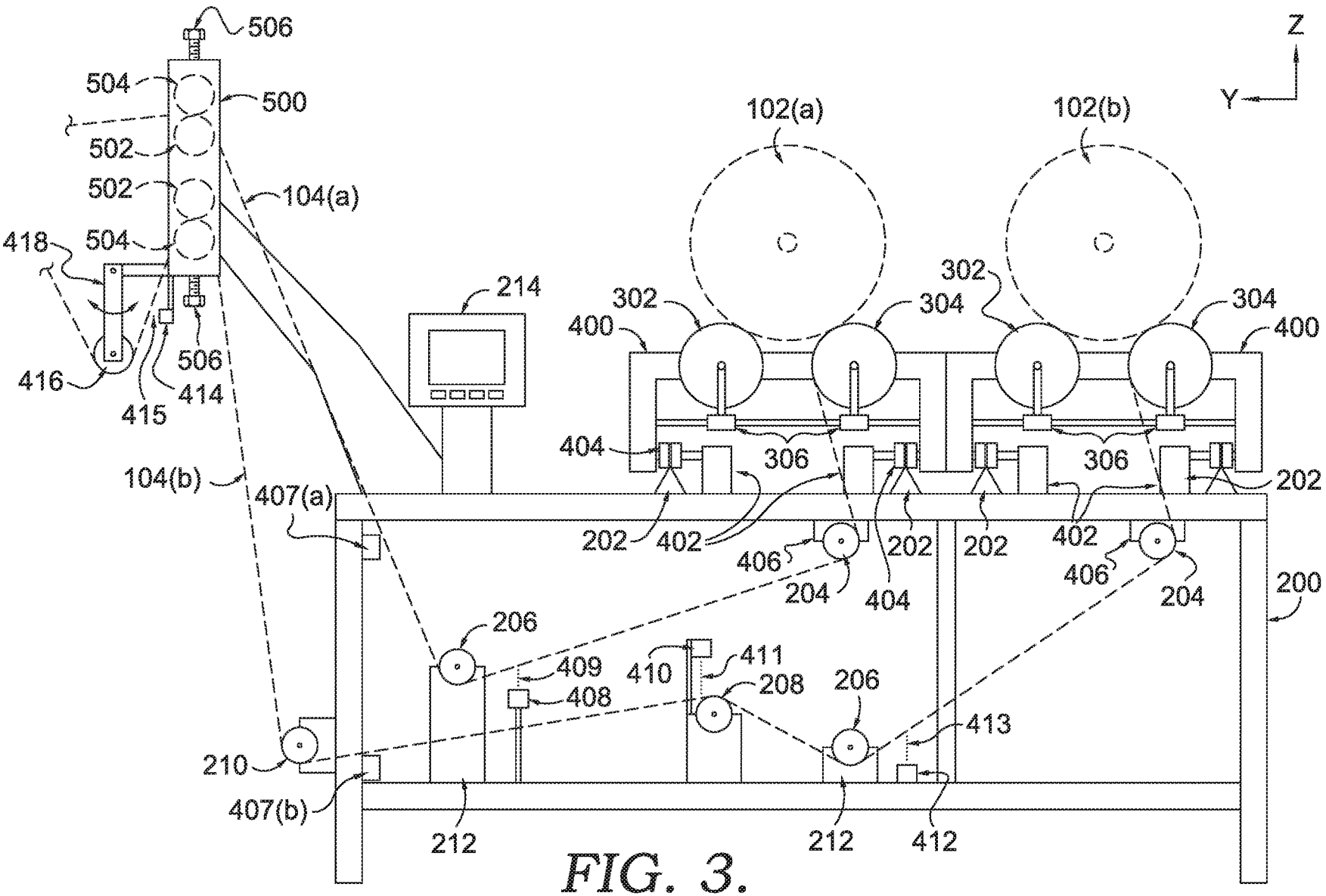
FIG. 3 depicts a side plan view of the material feeder from FIG. 2, in accordance with aspects hereof.

As depicted in FIGS. 1 and 3, exemplary alternative positions for a position sensor are provided. In FIG. 1 a position sensor 407 is depicted. The position sensor 407 is equivalent to the previously discuss position sensor 406, but in a different location relative to the roller combination 300. The position sensor 407 is illustrated to demonstrate alternative locations for a position sensor. In an exemplary aspect, locating a position sensor closer (e.g., in the Y-axis direction) to a subsequent operation (e.g., downstream in the material feed direction) allows for better X-axis position control of the unrolled material as provided to a subsequent operation. Therefore, locating the position sensor 407 at a location in the Y-axis direction in a downstream feed location from the roller combination 300 can allow for better rectification of material in some examples. FIG. 3 depicts a position sensor 407(*a*) associated with the first unrolled material 104(*a*) and a position sensor 407(*b*) associated with the second unrolled material 104(*b*). The position sensor 407(*a*) and the position sensor 407(*b*) are exemplary in nature and not limiting. It is contemplated that one or more positions sensors (e.g., 406, 407, 407(*a*), 407(*b*)) effective to detect a position of a material may be implemented in any combination and location of the system in various aspects. Further, depending on a material being fed through the system, a location of a position sensor may be adjusted to achieve acceptable levels of edge position accuracy.

The position sensor 408 is depicted as an alternative or additional position sensor. The position sensor 408 may have the same or similar capabilities as those discussed with the position sensor 406, in exemplary aspects. For example, the position sensor 408 may emit the position detection 409 energy field (e.g., visible light, infrared light, ultrasonic energy) that is effective to determine a position (or at least lack) of material, such as along a longitudinal edge of the unrolled material 104. In response to a detected position of the material by the position sensor 408, the system causes the rectifying frame 400 to move in a direction to bring the material position back into a tolerable zone. Similarly, other position sensors, such as position sensors 406, 407, 407(*a*), 407(*b*), 408, 408(*b*), 410, 410(*b*), 412, and 412(*b*), may have position detection energy fields or mechanical engagements (e.g., position detection 411 and 413).

The roller combination 300 supports and rotates a material roll, such as the rolled material 102. The roller combination 300 is comprised of the first roller 302 and the second roller 304. The first roller 302 is a cylindrical element having a rotational axis 308 in the x-axis direction of FIGS. 1-5. The rotational axis 308 extends in a direction parallel to a longitudinal direction of each roller. The second roller 304 also has a rotational axis 308 parallel to the counterpart axis of the first roller 302. The roller combination 300 contemplates having similarly sized rollers (e.g., first roller 302 and second roller 304) in at least one of a diameter and/or longitudinal length. Further, the roller combination 300 contemplates having respective axis of rotation in a plane parallel to the X-Y axis plane of FIGS. 1-5.

A spacing between rollers forming the roller combination 300 may be static or dynamic. For example, it is contemplated that one or more of the first roller 302 and/or the second roller 304 may be repositionable in the Y-axis direction of FIGS. 1-5 to accommodate different sized material rolls. For example, to aid in providing stability and structure to a feeding operation, the spacing in the Y-axis direction between rollers may be increased for larger material rolls and reduced for smaller material rolls.

The rollers forming the roller combination 300 may be formed from any material, such as a polymer-based material or a metallic material. Further, it is contemplated that multiple materials may form the roller, such as a polymer surface exposed to the material roll to be fed and an internal metallic structure. Further, it is contemplated that one or more friction-reducing members, such as ball bearings, may be included in one or more rollers. Further yet, it is contemplated that a series of rollers aligned in an x-axis direction having a common axis of rotation may be used. In this example, some of the rollers may be passive rollers intended to freely rotate while supporting a material roll and other rollers in this serial configuration are powered rollers to drive a rotation of the material roll being supported thereon. As such, while continuous rollers are depicted extending in the longitudinal direction (e.g., x-axis), aspects hereof contemplate a plurality of rollers forming a rotational surface(s) along a common axis of rotation. A serial configuration of rollers is applicable to all discussions of rollers herein.

The roller combination 300 is further comprised of the drive assembly 306 effective to cause a rotation about the rotational axis 308 of one or more rollers forming the roller combination 300. The drive assembly 306 may be any force-generating mechanism to generate a rotational force at one or more rollers. Examples include, but are not limited to, electric motor, hydraulic motor, pneumatic motor, and the like. Further, the drive assembly may be further comprised of a translation element to translate energy force generated by the force-generating mechanisms to the one or more rollers of the roller combination 300. Examples of a translation element include, but are not limited to, a gear(s), pulley, belt(s), shafts, chain(s), sprocket(s), transmission, and the like in any combination. The translation element may increase or reduce a rotational speed, force, torque and the like. It is contemplated that the force-generating mechanism and the translation element may be integrally formed and/or mechanically/operatively joined. As a result, the drive assembly 306 is effective to cause a rotation of one or more rollers of the roller combination 300 to aid in the unrolling (and/or rolling) of one or more material rolls.

It is contemplated that each roller may have an independent drive assembly 306. Alternatively, it is contemplated that a common drive assembly is operatively coupled with two or more rollers of the roller combination 300 to rotate the two or more rollers in concert.

The material feeder 101 is further comprised of the dispensing assembly 500 effective to transfer material from the material feeder 101 to a subsequent operation, such as a laser cutting apparatus. The dispensing assembly is comprised of one or more combination of rollers. The combination of rollers work in concert to pull material from the frame 200 towards the subsequent operation, such as that performed by the receiving unit 600. The combination of rollers may be comprised of the drive roller 502 powered by the drive unit 508 to rotate and pull material through the combination of rollers. Further, the combination of rollers is comprised of the compression roller 504, which is adjustable in a general Z-axis direction by the compression adjustment 506. In use, the drive roller 502 and the compression roller 504 are positioned relative to one another in a manner that allows material to feed between the rollers while providing sufficient compression on the material to effectively grasp and convey the material there between. Stated differently, a compressive force generated between the compression roller 504 and the drive roller 502 and as adjustable by the compression adjustment 506 interacts with a material passing between the rollers to effective convey the material as the drive roller 502 is rotated by the drive unit 508.

The drive unit 508 is effective to cause a rotation of the drive roller 502 to aid in conveying and pulling material through the dispensing assembly 500. The drive unit 508 may be any force-generating mechanism to generate a rotational force at one or more rollers. Examples include, but are not limited to, electric motor, hydraulic motor, pneumatic motor, and the like. Further, the drive unit may be further comprised of a translation element to translate energy force generated by the force-generating mechanisms to the drive roller 502. Examples of a translation element include, but are not limited to, a gear(s), pulley, belt(s), shafts, chain(s), sprocket(s), transmission, and the like in any combination. The translation element may increase or reduce a rotational speed, force, torque and the like. It is contemplated that the force-generating mechanism and the translation element may be integrally formed and/or mechanically/operatively joined. As a result, the drive unit 508 is effective to cause a rotation of one or more rollers of dispensing assembly 500 to aid in the unrolling (and/or rolling) of one or more material rolls.

While illustrated as the compression adjustment 506 adjusting a position of the compression roller 504, it is contemplated that the compression adjustment 506 may instead or additional adjust a position of the drive roller 502 to affect a compression provided between the drive roller 502 and the compression roller 504.

As will be depicted in FIGS. 2-5 hereinafter, it is contemplated that the dispensing assembly 500 may be comprised of two or more combinations of rollers with each effective to convey a different material concurrently.

Exemplary aspects contemplate the tension roller 416 positioned in a downstream material flow direction from the drive roller 502. The tension roller 416 extends from the dispensing assembly 500 and/or the frame 200 by way of the tension roller link 418. The tension roller link 418 may allow for a free-pivoting motion of the tension roller 416 relative to the dispensing assembly 500 and/or the frame 200. Stated differently, it is contemplated that the tension roller 416 freely swings in the y direction. In this case, the pivotal movement of the tension roller may be caused by a change in tension of the unrolled material 104. For example, if the receiving unit 600 is taking in the unrolled material 104 faster than the roller combination 300 is unrolling the material, a tension in the unrolled material 104 may increase. As the tension in the unrolled material 104 increases, the tension roller 416 may pivot towards the receiving unit 600 as the unrolled material 104 applies a force on the tension roller 416. The degree of deflection (e.g., amount of pivotal rotation) of the tension roller link 418 maintaining the tension roller 416 increases with an increase in tension experienced by the unrolled material 104. The tension measured by the deflection of the tension roller link may be an isolated tension between the dispensing assembly 500 and the receiving unit 600 due to the compressive nature of the dispensing assembly 500, in an exemplary aspect. The degree of deflection may be measured using mechanical measurement of degree of rotation, distance of deflection, and the like. The measure of deflection of the tension roller link 418 may be accomplished with a mechanical device, an optical device, an ultrasonic device and the like.

In an additional or alternative example, an amount of tension in the unrolled material 104 is determined with the tension sensor 414. As with other tension sensors (e.g., tension sensor 212), a tension (or representation of tension) may be measured using visible light, infrared light, ultrasonic energy, mechanical measurement and the like. For example, the tension sensor 414 may emit an energy 415 (e.g., light, sound) field that is then used to determine a distance of the unrolled material 104 from the tension sensor 414. As tension increases, the tension roller link 418 pivots allowing the unrolled material 104 to extend away from the tension sensor 414. Therefore, as tension in the unrolled material increases after the dispensing assembly 500 in a material flow direction, a distance between the unrolled material 104 and the tension sensor 414 also increases. Conversely, as tension in the unrolled material decreases after the dispensing assembly 500 in a material flow direction, a distance between the unrolled material 104 and the tension sensor 414 also decreases. In these examples, a distance measurement between the material and the sensor serves as a representation of tension experienced by a material. The actual tension experienced by the material may be determined by assessing a variety of factors, such as the length of the tension roller link 418, the mass of the tension roller 416, the pivoting resistance of the tension roller link 418, and the like.

The tension sensor 414 is effective to communicate with a processor to cause a change in unroll rate of the material 102 by the roller combination 300. For example, the material may be unrolled at a given rate so long as a distance measured by the tension sensor 414 is within a defined window of distance. The defined window may have a lower limit distance that is greater than a measurement between the unrolled material 104 and the tension sensor 414 when the tension roller link is perpendicular to the ground. Stated differently, the measurement window may have a lower limit that requires at least a portion of tensile force of the unrolled material 104 being transferred to the tension roller 416 causing a pivot of the tension roller link 418 (i.e., the unrolled material is acting against a gravity preferred position of the free pivoting tension roller link 418). By having the lower limit inclusive of a slight contact with the tension roller 416 in this example, contact between the unrolled material 104 and the tension roller 416 can be ensured through measurement by the tension sensor 414 (i.e., this ensures excess material does not unroll to the floor while only using a tensile sensor).

Returning to the frame 200, it is comprised of at least the initial roller 204, the tension roller 206, the material sensor 216, and the tension sensor 212. The initial roller 204 is a roller that redirects material from below (e.g., in the negative Z-axis direction) the roller combination 300 toward the tension roller 206. In an exemplary aspect, the initial roller 204 is positioned having an external surface in the material-feed path that is behind (e.g., in the negative Y-axis direction) a forward external surface of the second roller 304. As depicted in FIG. 1, this relative orientation allows for the material to pull against the second roller 304 to aid in maintain the rolled material 102 in an intended location relative to the roller combination 300 as the material is being fed through the material feeder 101.

The material sensor 216 is a sensor for detecting the presence or absence of material. Similar to the position sensors 406, 407, 407(*a*), 407(*b*), 408, 408(*b*), 410, 410(*b*), 412, and 412(*b*), the material sensor 216 may be a contact or contact-less sensor. Therefore, it is contemplated that the material sensor 216 may be a mechanical contact sensor, an infrared sensor, a visible light sensor, ultrasonic sensor, and the like. The material sensor 216 is effective to signal one or more elements of the material feeder to cease or start operation. For example, if the material sensor 216 fails to detect a material, the material feeder may cease operation or adjust operation for loading a new material or completing an existing material roll.

In some aspects, it is contemplated that the tension roller 206 and the tension sensor 212 to measure tension of the unrolled material. However, it is also contemplated that the tension sensor 212 may be omitted or not implemented in connection with the tension roller 206 in some aspects. The tension roller 206 is positioned below (e.g., in the negative Z-axis direction) relative to the initial roller 204 and to a subsequent material roller (e.g., dispensing assembly 500 roller, first supplemental roller 208 of FIG. 3). The relative positioning of the tension roller 206 allows for the tension sensor 212 to measure an upward force (e.g., in a positive Z-axis direction) generated by the material interacting with the tension roller 206. The upward force is an indicator of tension (i.e. representation of tension) experienced by the material. The tension sensor 212 may be a load sensor capable of measuring a relative force imposed on the tension sensor 212 through the tension roller 206 by the material (e.g., unrolled material 104). While the force measured by the tension sensor 212 may not be equivalent to the tension experienced by the material itself, the relative value of force measured by the tension sensor 212 may be equated to or correlated to ranges of tension experienced with the material. Stated differently, as tension increases in material passing through the tension roller 206, the upward force applied by the material on the tension roller 206 increases. Therefore, as the upward force caused by the relative position of the tension roller in the material feeder as measured by the tension sensor 212 increases, the tension of the material also increases.

The computing device 214 is comprised of a processor and memory effective to execute one or more computer-readable instructions for controlling one or more elements provided herein. It is contemplated that one or more of the sensors (e.g., tension sensor 212, material sensor 216, position sensor 406), one or more drive elements (e.g., drive assembly 306, movement system 402, drive unit 508), and/or one or more manufacturing controllers may be operatively (e.g., wired or wireless) connected with the computing device 214. As such, the computing device 214 is effective to take one or more inputs and/or one or more computer readable instructions to cause one or more elements to adjust.

For example, as a position sensor, such as position sensor 406, 407, 407(*a*), 407(*b*), 408, 408(*b*), 410, 410(*b*), 412, and/or 412(*b*), detect an offset of the material, the computing device 214 may instruct the movement system 402 to adjust a position of the rectifying frame 400 to bring the material back into a tolerable positional offset. It is also contemplated that as the tension sensor, such as tension sensor 212 and/or 414, detect an increase in tension above a tolerable range, the computing device 214 may increase a rotational speed as provided by the drive assembly 306. When the tension sensor, such as tension sensor 212 and/or 414, detects a decrease in tension of the material, the computing device 214 may decrease a rotational speed as provided by the drive assembly 306. Further yet, it is contemplated that the computing device 214 may adjust (e.g., cease, decrease, increase) a rotational speed of the drive assembly 306 in response to input from the material sensor 216. For example, if the material sensor 216 detects an absence of material, the computing device 214 may cause the drive assembly to cease rotation, in an exemplary aspect. Additionally, the computing device 214 may adjust a rotational speed provided by the drive unit 508 in response to one or more inputs and/or computer-readable instructions. As such, it is contemplated that the computing device 214 may adjust any parameter, such as tension, position, and/or speed in response to a signal, input, and/or computer readable instructions.

FIGS. 2-5 depict the material feeder 100 in accordance with aspects hereof. The material feeder 100 incorporates elements discussed in connection with FIG. 1. Further, the material feeder 100 is adapted to feed additional rolls of material through the material feeder concurrently. As such, the material feeder 100 includes two independently operable roller combinations 300, one for each material rolls to be concurrently fed. The material feeder 100 is comprised of two independently controlled rectifying frames 400, one for each material roll to be concurrently fed. Additionally, the dispensing assembly 500 is comprised of multiple independently controlled combinations of rollers (e.g., drive roller 502 and compression roller 504), one for each material roll to be concurrently fed.

While independently controlled, it is also contemplated that one or more elements servicing different material rolls may be controlled in concert in an exemplary aspect. For example, the elements of the dispensing assembly 500 may be uniformly controlled to provide consistency to the downstream operation(s) and adjustments may be made at the roller combination 300 to ensure relatively consistent tension and feed rate to the dispensing assembly 500, in an exemplary aspect.

Figure 2:
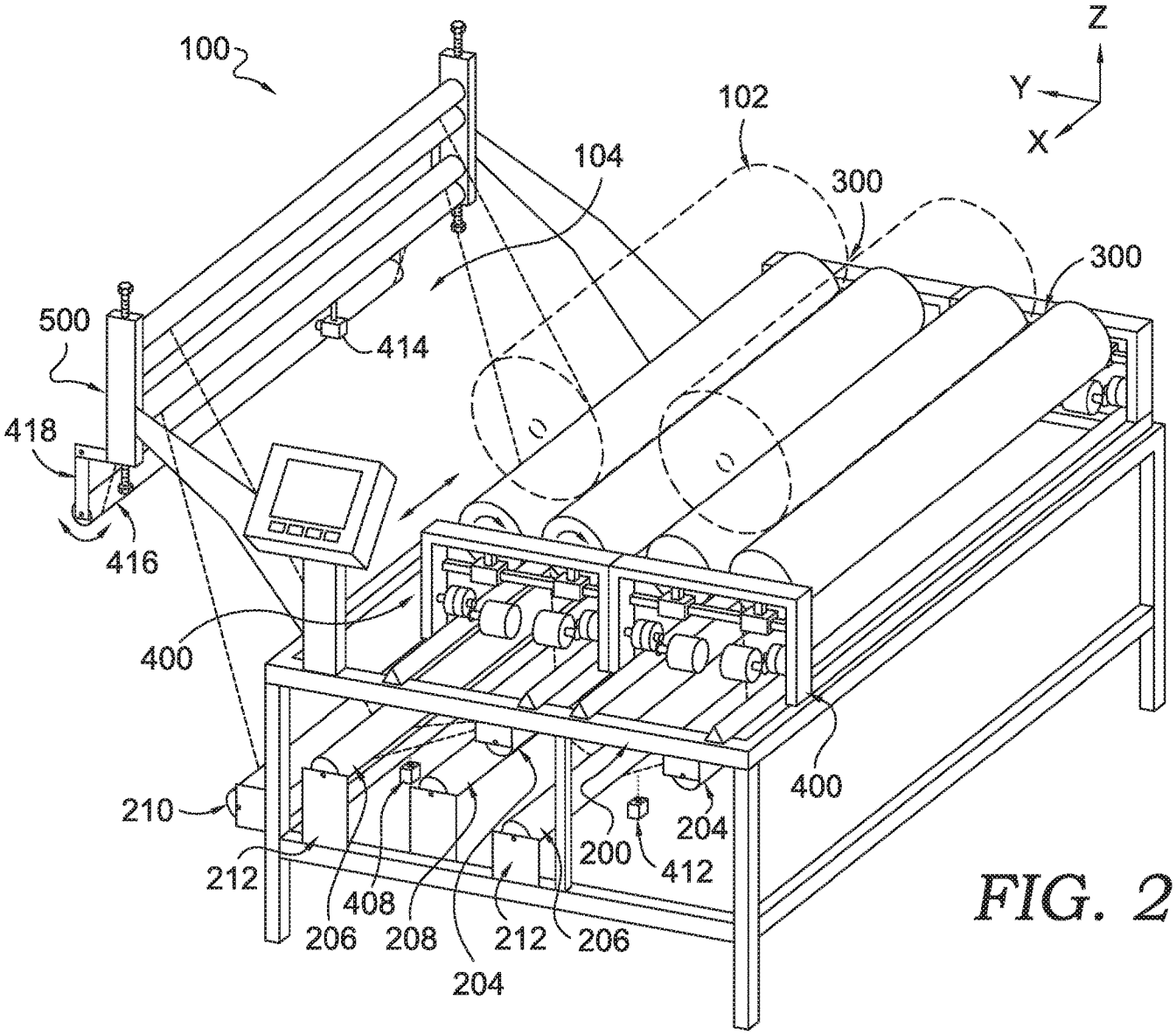
FIG. 2 depicts a perspective view of a material feeder, in accordance with aspects hereof.
Figure 4:
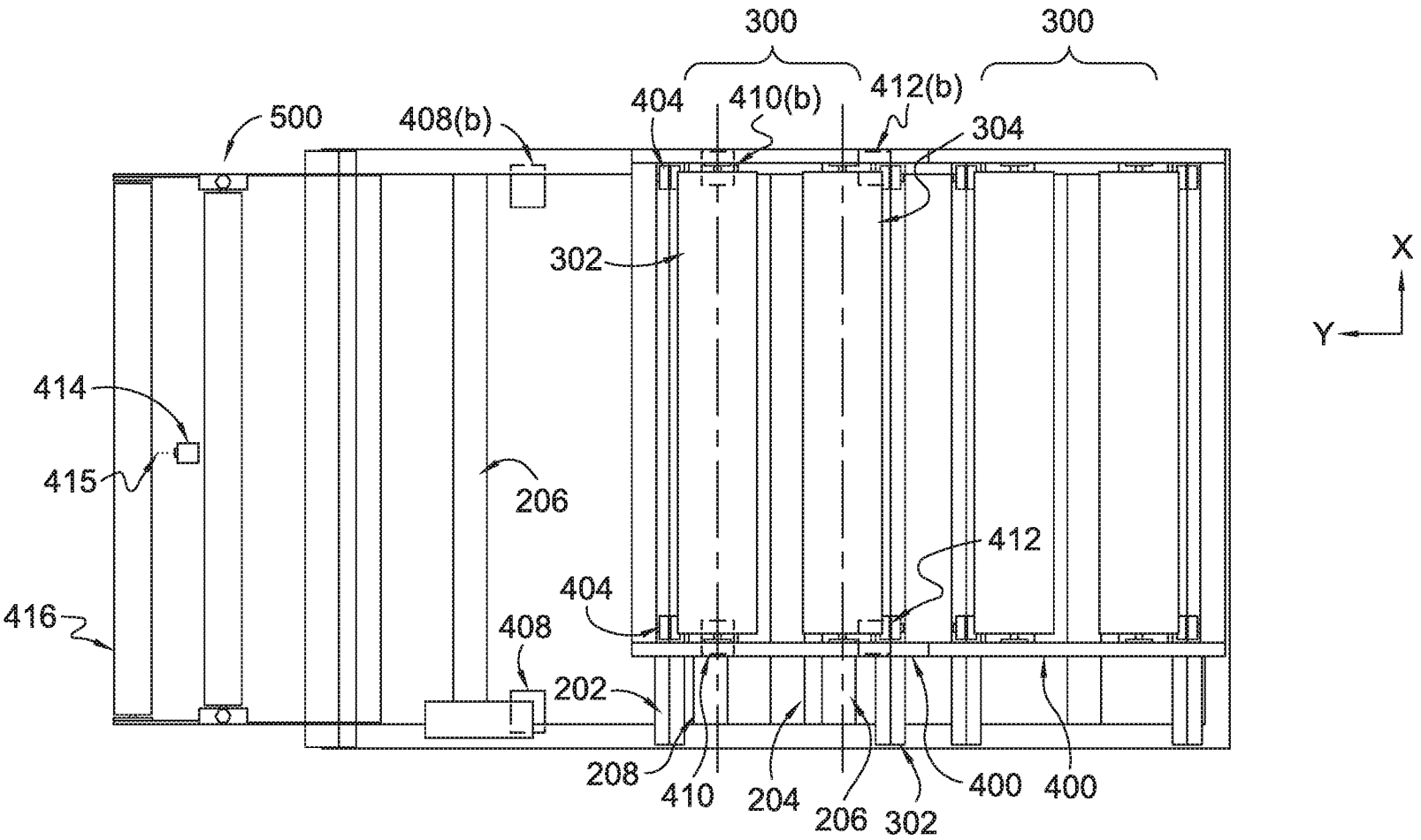
FIG. 4 depicts a top plan view of the material feeder from FIG. 2, in accordance with aspects hereof.
Figure 5:
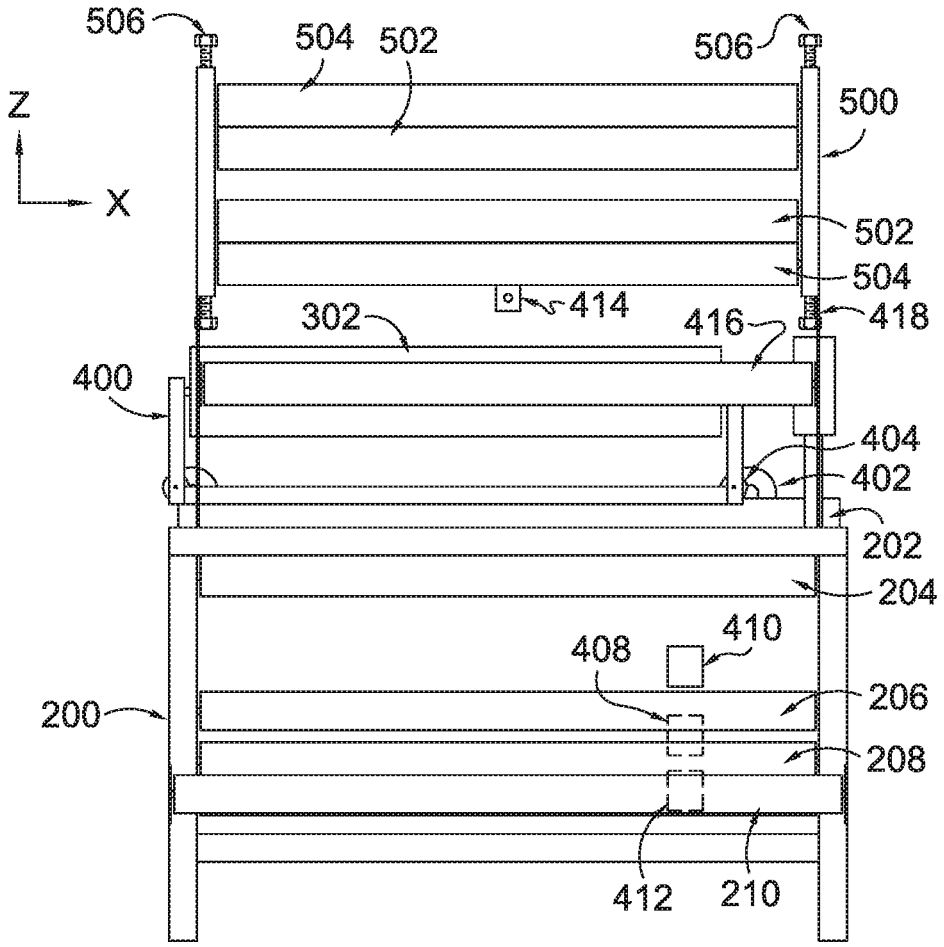
FIG. 5 depicts a front plan view of the material feeder from FIG. 2, in accordance with aspects hereof.

FIG. 2 depicts a perspective view of the material feeder 100, in accordance with aspects hereof. FIG. 3 depicts a side view of the material feeder 100, in accordance with aspects hereof. FIG. 4 depicts a top view of the material feeder 100, in accordance with aspects hereof. FIG. 5 depicts a front view of the material feeder 100, in accordance with aspects hereof.

FIG. 2 provides a view of the first supplemental roller 208 and the second supplemental roller 210. The first supplemental roller 208 and the second supplemental roller 210 aid in directing the second unrolled material 104(*b*) in a manner that allows for tension measurement and prevent interference with a material feed path of the first unrolled material 104(*a*). For example, the first supplemental roller 208 is positioned above the tension roller 206 in the second unrolled material 104(*b*) feed path. This upward positioning allows for the tension roller 206 of the second unrolled material 104(*b*) feed path to measure tension (e.g., upward force provided by the unrolled material 104(*b*)) as applied to the tension roller 206.

As previously provided, it is contemplated that the material feeder 100 is adapted to unroll and positionally adjust two or more material rolls simultaneously. For example, the first rolled material 102(*a*) and the second rolled material 102(*b*) are simultaneously fed through the material feeder 100. In this manner, the unrolled material 104(*a*) and 104(*b*) pass through the dispensing assembly 500 concurrently for subsequent processing, such as at a laser cutting device. By passing two different materials on to a subsequent operation, the utilization of the subsequent device may be increased (e.g., cut two layers of material during a single operation on a laser cutting table). However, in some examples, it is advantageous for subsequent operations to ensure both layers of fabric are conveyed from the material feeder 100 with tensions being held within their respective acceptable ranges. For example, if the first rolled material 102(*a*) is a fine knit material that is relatively light weight and susceptible to deformation with excessive tension and the second rolled material 102(*b*) is a heavy weight woven material that requires significant tension to maintain a consistent material feed, different tensions can be maintained for each material with the material feeder 100 utilizing elements and steps provided herein. Further, each roll of material may have different roll consistencies that affect longitudinal movement (e.g., lateral offset in the x-axis direction). In this example, having independently controlled and operable rectifying frames 400 allow both fabric rolls to be positionally adjusted as needed during the conveying process. This allows for aligned materials to be dispensed in unison from the dispensing assembly 500.

A variety of components (e.g., sensors, adjusters, rollers, links, components, and the like) are disclosed herein. It is understood that the components may be optional and/or may be implemented in any combination. For example, the tension sensor 212 and the tension sensor 414 may be used in combination to determine tension at different portions of the unrolled material 104. Further, the determinations from the different tension sensors (212, 414) may cause different portions of the system to operate independently. For example, the tension sensor 414 may provide input for the speed of distribution of the unrolled material 104 from the dispensing assembly 500 while the tension sensor 212 may provide input for the speed of distribution from the roller combination 300 of the unrolled material 104. Additionally or alternatively, a single tension sensor (e.g., 212, 414) may provide inputs to multiple components to uniformly control unrolling of the material. Similarly, any combination of position sensors (e.g., 406, 407, 407(*a*), 407(*b*), 408, 408(*b*), 410, 410(*b*), 412, and/or 412(*b*)) may be leveraged to provide input for movement by the rectifying frame 400. As previously discussed, any of the sensors may be optional or omitted altogether, in exemplary aspects.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

Clauses contemplated herein include:

1. A material feeding device, comprising: a roller combination comprised of a first roller and a second roller, the first roller and the second roller having parallel rotational axis; a drive assembly adapted to rotate the roller combination in at least a rotational first direction effective to roll and convey a rolled material; and a rectifying frame joined with the roller combination and adapted to axially position the roller combination to rectify a position of the material conveyed from the material feeding device.

2. The material feeding device according to clause 1, wherein the rectifying frame includes a movement system that adjusts the position of the roller combination in a first direction and a second direction parallel to the rotational axis of the first roller.

3. The material feeding device according to clause 1, further comprising a computing device for controlling tension adapted to: control the rotation speed of the roller combination to increase the conveying speed of the material when detecting that a representation of a tension value of the material being conveyed is greater than a first tension value, and control the rotation speed of the roller combination to reduce the conveying speed of the material when detecting that the representation of the tension value is less than a second tension value, wherein the first tension value is greater than the second tension value.

4. The material feeding device according to clause 1 or 2, further comprising: a position sensor and a computing device, wherein the position sensor is adapted to monitor the position of the material being conveyed and to send a rectifying signal to the computing device relating to an offset of the position of the material; and the computing device is adapted to control the movement of the rectifying frame and thereby rectifying the position of the material, in response to receiving the position signal.

5. The material feeding device according to clause 4, wherein the number of the position sensor is one and the position sensor is provided on a first side of the material feeding device in the axial direction of the first roller.

6. The material feeding device according to clause 4, wherein the position sensor comprises an ultrasonic sensor, an infrared sensor, or a mechanical sensor.

7. The material feeding device according to clause 1, further comprising: a drive roller having an axis of rotation parallel to the axis of rotation of the first roller; and a drive unit operatively coupled with the drive roller to rotate the drive roller about the rotational axis of the drive roller.

8. The material feeding device according to clause 1, further comprising a material sensor to detect the presence of the material being conveyed and to signal for an adjustment to a parameter of the material feeding device.

9. The material feeding device according to clause 1, wherein the number of the roller combinations is two, and the number of the rectifying frames is two.

10. The material feeding device according to clause 9, further comprising: a drive roller having an axis of rotation parallel to the axis of rotation of the first roller; and a drive unit operatively coupled with the drive roller to rotate the drive roller about the rotational axis of the drive roller.

11. The material feeding device according to clause 10, wherein the number of the drive rollers is one or two.

12. A material feeding method with a roller combination having two rollers with parallel axis of rotation, the method comprising: driving the roller combination to rotate, thus making a rolled material carried thereon roll and be conveyed; and driving a rectifying frame to move the roller combination in a direction parallel to the axis of rotation thereby rectifying the position of the material, when an offset of the position of the material is detected after the roller combination is driven to rotate.

13. The material feeding method according to clause 12, further comprising adjusting a rotational speed of the roller combination in response to an indication of tension of the material being conveyed.

14. The material feeding method according to clause 12, further comprising: detecting a tension value of a portion of unrolled material from the rolled material when the unrolled material is being conveyed; when detecting that the tension value is greater than a first tension value, a computing device controlling a rotation speed of the roller combination to increase the conveying speed of the unrolled material; and when detecting that the tension value is less than a second tension value, the computing device controlling the rotation speed of the roller combination to reduce the conveying speed of the unrolled material, wherein the first tension value is greater than the second tension value.

15. The material feeding method according to clause 13 or 14, further comprising: after driving the roller combination to rotate and before driving the rectifying frame to move, a position sensor detecting the position of the unrolled material being conveyed; and a computing device controlling the movement of the rectifying frame according to a rectifying signal from the position sensor to rectify the position of the unrolled material.

16. The material feeding method according to clause 14, further comprising: driving a second rectifying frame to move in a direction parallel to the axis of rotation, thus making a second roller combination move axially and thereby rectifying a position of a second unrolled material.

17. The material feeding method according to clause 12, 13 or 14, further comprising: after the unrolled material is conveyed, applying compression with a drive roller and a compression roller to the unrolled material; and by a drive unit operatively coupled with the drive roller, rotating the drive roller about a rotational axis of the drive roller thereby allowing the drive roller to assist in the conveyance of the unrolled material.

18. The material feeding method according to clause 12, further comprising when a material sensor senses the unrolled material, adjusting a parameter of the roller combination.

19. A material feeding device having a roller combination comprised of a first roller and a second roller, the first roller and the second roller having parallel rotational axis; a drive assembly adapted to rotate the roller combination in at least a rotational first direction effective to roll and convey a rolled material; a rectifying frame joined with the roller combination and adapted to axially position the roller combination to rectify a position of the material conveyed from the material feeding device; a tension sensor effective to measure a relative tension of the material after being conveyed by the roller combination; and a computing device for controlling tension of the rolled material, the computing device effective to: control the rotation speed of the roller combination to increase the conveying speed of the material when detecting that a representation of a tension value from the tension sensor is greater than a first tension value, and control the rotation speed of the roller combination to reduce the conveying speed of the material when detecting that the representation of the tension value from the tension sensor is less than a second tension value, wherein the first tension value is greater than the second tension value.

20. The material feeding device of clause 19, wherein the tension sensor senses tension of the material using light energy, ultrasonic energy, or force measurement.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

What is claimed is:

1. A material feeding device, comprising:

a roller combination comprised of a first roller and a second roller, the first roller and the second roller having parallel rotational axis;

a drive assembly adapted to rotate the roller combination in at least a rotational first direction effective to roll and convey a rolled material;

a rectifying frame joined with the roller combination and adapted to axially position the roller combination to rectify a position of the material conveyed from the material feeding device; and a computing device effective to control tension, the computing device adapted to: control the rotation speed of the roller combination to increase the conveying speed of the material when detecting that a representation of a tension value of the material being conveyed is greater than a first tension value, and control the rotation speed of the roller combination to reduce the conveying speed of the material when detecting that the representation of the tension value is less than a second tension value, wherein the first tension value is greater than the second tension value.

2. The material feeding device according to claim 1, wherein the rectifying frame includes a movement system that adjusts the position of the roller combination in a first direction and a second direction parallel to the rotational axis of the first roller.

3. The material feeding device according to claim 1, further comprising: a position sensor and a computing device, wherein the position sensor is adapted to monitor the position of the material being conveyed and to send a rectifying signal to the computing device relating to an offset of the position of the material; and the computing device is adapted to control the movement of the rectifying frame and thereby rectifying the position of the material, in response to receiving the position signal.

4. The material feeding device according to claim 3, wherein the number of the position sensor is one and the position sensor is provided on a first side of the material feeding device in the axial direction of the first roller.

5. The material feeding device according to claim 3, wherein the position sensor comprises an ultrasonic sensor, an infrared sensor, or a mechanical sensor.

6. The material feeding device according to claim 1, further comprising: a drive roller having an axis of rotation parallel to the axis of rotation of the first roller; and a drive unit operatively coupled with the drive roller to rotate the drive roller about the rotational axis of the drive roller.

7. The material feeding device according to claim 1, further comprising a material sensor to detect the presence of the material being conveyed and to signal for an adjustment to a parameter of the material feeding device.

8. The material feeding device according to claim 1, wherein the number of the roller combinations is two, and the number of the rectifying frames is two.

9. The material feeding device according to claim 8, further comprising: a drive roller having an axis of rotation parallel to the axis of rotation of the first roller; and a drive unit operatively coupled with the drive roller to rotate the drive roller about the rotational axis of the drive roller.

10. The material feeding device according to claim 9, wherein the number of the drive rollers is one or two.

11. A material feeding method with a roller combination having two rollers with parallel axis of rotation, the method comprising:

driving the roller combination to rotate, thus making a rolled material carried thereon roll and be conveyed;

driving a rectifying frame to move the roller combination in a direction parallel to the axis of rotation thereby rectifying the position of the material, when an offset of the position of the material is detected after the roller combination is driven to rotate; and detecting a tension value of a portion of unrolled material from the rolled material when the unrolled material is being conveyed;

when detecting that the tension value is greater than a first tension value, a computing device controlling a rotation speed of the roller combination to increase the conveying speed of the unrolled material; and when detecting that the tension value is less than a second tension value, the computing device controlling the rotation speed of the roller combination to reduce the conveying speed of the unrolled material, wherein the first tension value is greater than the second tension value.

12. The material feeding method according to claim 11, further comprising adjusting a rotational speed of the roller combination in response to an indication of tension of the material being conveyed.

13. The material feeding method according to claim 12, further comprising: after driving the roller combination to rotate and before driving the rectifying frame to move, a position sensor detecting the position of the unrolled material being conveyed; and a computing device controlling the movement of the rectifying frame according to a rectifying signal from the position sensor to rectify the position of the unrolled material.

14. The material feeding method according to claim 11, further comprising: driving a second rectifying frame to move in a direction parallel to the axis of rotation, thus making a second roller combination move axially and thereby rectifying a position of a second unrolled material.

15. The material feeding method according to claim 11, further comprising: after the unrolled material is conveyed, applying compression with a drive roller and a compression roller to the unrolled material; and by a drive unit operatively coupled with the drive roller, rotating the drive roller about a rotational axis of the drive roller thereby allowing the drive roller to assist in the conveyance of the unrolled material.

16. The material feeding method according to claim 11, further comprising when a material sensor senses the unrolled material, adjusting a parameter of the roller combination.

17. A material feeding device, comprising:

a roller combination comprised of a first roller and a second roller, the first roller and the second roller having parallel rotational axis; a drive assembly adapted to rotate the roller combination in at least a rotational first direction effective to roll and convey a rolled material;

a rectifying frame joined with the roller combination and adapted to axially position the roller combination to rectify a position of the material conveyed from the material feeding device; a tension sensor effective to measure a relative tension of the material after being conveyed by the roller combination; and a computing device for controlling tension of the rolled material, the computing device effective to: control the rotation speed of the roller combination to increase the conveying speed of the material when detecting that a representation of a tension value from the tension sensor is greater than a first tension value, and control the rotation speed of the roller combination to reduce the conveying speed of the material when detecting that the representation of the tension value from the tension sensor is less than a second tension value, wherein the first tension value is greater than the second tension value.

18. The material feeding device of claim 17, wherein the tension sensor senses tension of the material using light energy, ultrasonic energy, or force measurement.

* * * * *